US007383980B1

(12) United States Patent
Beacham

(10) Patent No.: US 7,383,980 B1
(45) Date of Patent: Jun. 10, 2008

(54) COMPARTMENTED BANK

(76) Inventor: Michael L. Beacham, 630 Meadowood Dr., Lake Forest, IL (US) 60045

( * ) Notice: Subject to any disclaimer, the term of this patent is extended or adjusted under 35 U.S.C. 154(b) by 0 days.

(21) Appl. No.: 11/850,367

(22) Filed: Sep. 5, 2007

(51) Int. Cl.
*A47G 29/00* (2006.01)

(52) U.S. Cl. ..... 232/4 R; 446/8; 109/53; 206/0.84

(58) Field of Classification Search ..... 232/4 R, 232/43.1, 44, 1 D; 446/8; 109/53, 55; 206/0.84, 206/0.83; D99/37–38
See application file for complete search history.

(56) References Cited

U.S. PATENT DOCUMENTS

| | | | | | |
|---|---|---|---|---|---|
| 269,673 | A | * | 12/1882 | Hotchkiss | 232/44 |
| 529,228 | A | * | 11/1894 | Wyler | 273/148 R |
| 1,570,572 | A | * | 1/1926 | Lowenstein | 232/4 R |
| 1,644,495 | A | * | 10/1927 | Shafer | 232/4 R |
| 1,716,823 | A | * | 6/1929 | Ko Eune | 232/4 R |
| 2,510,884 | A | * | 6/1950 | Greene | 446/8 |
| D170,574 | S | * | 10/1953 | Hickey | D99/36 |
| 3,992,805 | A | | 11/1976 | Arkin | |
| 4,023,728 | A | * | 5/1977 | Gamberg | 232/4 R |
| D303,035 | S | * | 8/1989 | O'Dunlaing | D99/40 |
| D354,831 | S | * | 1/1995 | Anderson | D99/35 |
| 5,482,487 | A | * | 1/1996 | Harris | 446/8 |
| D385,598 | S | * | 10/1997 | Stephensen et al. | D21/654 |
| D390,332 | S | * | 2/1998 | Searls | D99/37 |
| 5,716,211 | A | | 2/1998 | Vetter | |
| D436,427 | S | | 1/2001 | Grendahl | |
| D458,727 | S | * | 6/2002 | Beacham | D99/38 |
| 6,554,692 | B2 | * | 4/2003 | Knox et al. | 453/3 |
| 6,976,619 | B2 | | 12/2005 | Beacham et al. | |
| 2006/0292956 | A1 | * | 12/2006 | Sayles | 446/8 |

* cited by examiner

*Primary Examiner*—William L. Miller
(74) *Attorney, Agent, or Firm*—Clausen Miller P.C.

(57) ABSTRACT

A compartmented bank for holding money to be used for saving, spending or other budgetary purposes. The bank has a hollow body having openings in its upper surface and notched, removable plugs that fit in the openings to help define elongated slots through which coins or paper money can be inserted into the bank.

9 Claims, 4 Drawing Sheets

COMPARTMENTED BANK

BACKGROUND

1. Field of the Invention

This patent relates to a savings bank. More specifically, this patent relates to a compartmented savings bank in the shape of a pig or other multiple-appendaged animal and wherein the money is dispensed through openings located on the upper surface of the bank.

2. Description of the Related Art

Numerous savings banks are known in the art. Most of these feature a single compartment for storing coins. Some banks feature multiple compartments for storing money for different purposes, such as Shafer U.S. Pat. No. 1,644,495, Eune U.S. Pat. No. 1,716,823, Arkin U.S. Pat. No. 3,992,805, Vetter U.S. Pat. No. 5,716,211, Anderson U.S. Pat. No. Des. 354,831, Grendahl Des. 436,427 and applicant's own U.S. Pat. No. 6,976,619.

Shafer U.S. Pat. No. 1,644,495 discloses a lidded rectangular box into which are placed smaller boxes bearing indicia indicating the purpose to which the money stored in that particular box will be used.

Eune U.S. Pat. No. 1,716,823 discloses a rectangular box comprising rows of smaller boxes, each bearing a marking on its top cover indicating the suggested use of money placed in that box.

Arkin U.S. Pat. No. 3,992,805 discloses a coin bank having a hollow base shaped like a bird's nest, slide drawers mounted in the base, and bird figures on the base. Each bird figure includes a coin slot and bears a label indicative of a particular budgetary purpose, such as "Saving", "Spending" and "Sharing." The interior of the bank is divided into multiple compartments, each compartment communicating with one of the coin slots. The drawers can be used to access the money in the compartments.

Vetter U.S. Pat. No. 5,716,211 discloses a multiple compartment savings bank. Each compartment is shaped like a figure representative of the purpose for which money placed in that compartment will be used, such as a boat (retirement), a house (housing), a figure wearing a mortar board (college) and a pig (spending).

Anderson Des. 354,831 discloses a compartmented coin bank in which each compartment is labeled for a different budgetary purpose. The four compartments disclosed in the patent are labeled "Goal", "Giving", "Savings" and "Fun" respectively.

Grendahl Des. 436,427 discloses a compartmented savings bank comprising a hinged lid having a slot located over each compartment.

Applicant's Beacham et al. U.S. Pat. No. 6,976,619 discloses a compartmented bank shaped like a footed animal and comprising a plurality of feet, each foot communicating with one of the compartments so that money can be dispensed from each compartment through one of the feet.

Only one of these references, Grendahl Des. 436,427 disclose a multi-chambered bank in which the money is dispensed through the top of the bank. However, none, including Grendahl, disclose a compartmented savings bank having openings on top for receiving removable plugs, wherein the plugs are notched to help form elongated slots when the plugs are inserted into the openings. It is the primary object of the present invention to provide such a bank.

Another object of the present invention is to provide a bank that enables the user to save money for multiple budgetary purposes.

Still another object of the present invention is to provide a bank that can be used to help teach young persons how to manage money.

Further and additional objects will appear from the description, accompanying drawings, and appended claims.

SUMMARY OF THE INVENTION

The invention is a bank for holding money. The bank comprises a hollow body having openings in its upper surface and notched, removable plugs that fit in the openings to help define elongated slots through which coins or paper money can be inserted into the bank.

Each plug has two substantially straight, parallel sides connected by curved ends. The notch is formed in one of the substantially straight sides.

The hollow body is divided into a plurality of segregated compartments by internal walls. Each of the openings communicates with one of the compartments. Each plug bears indicia to indicate the budgetary purpose of the corresponding compartment. Alternatively, the body may bear indicia located near each opening to indicate the budgetary purpose of the corresponding compartment.

The bank may be shaped like an animal, and preferably like a pig. The pig preferably has a body, a head and four feet.

DRAWINGS

DETAILED DESCRIPTION OF THE INVENTION

Figure 1:
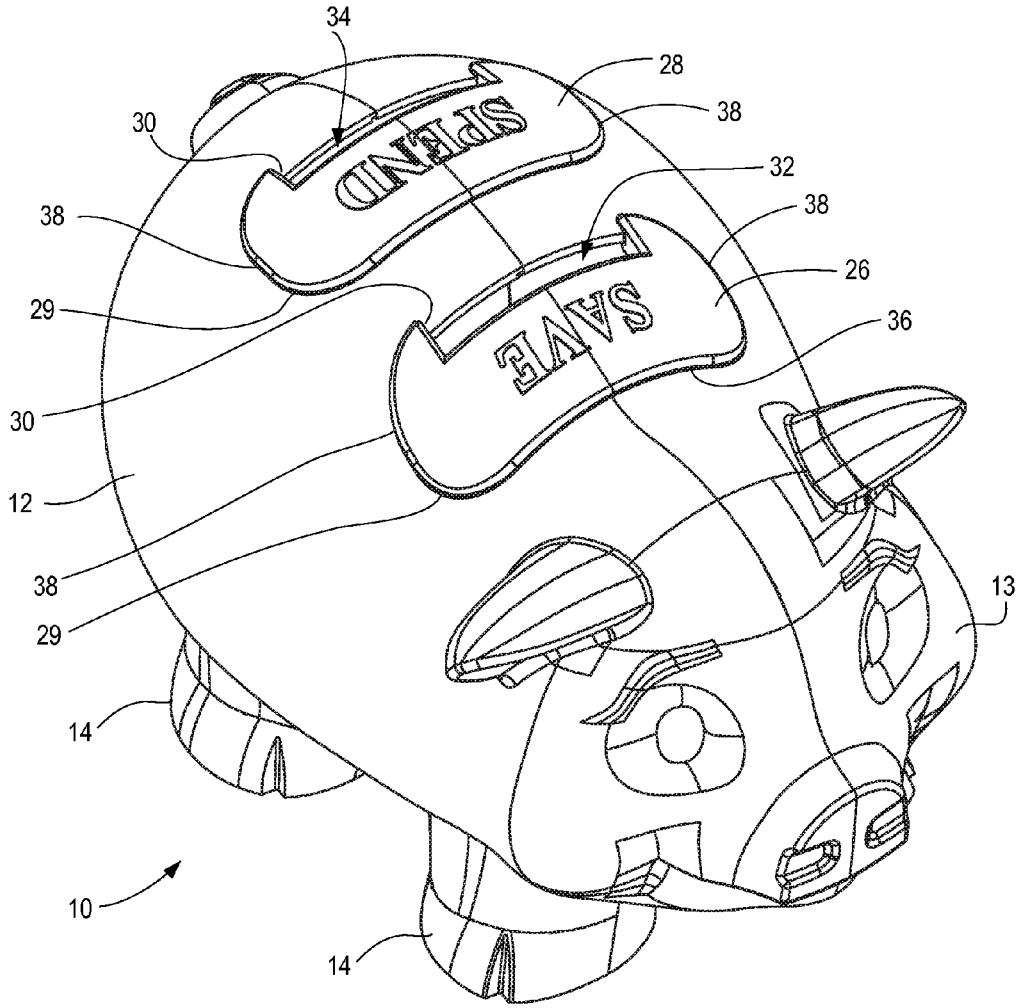
FIG. 1 is a perspective view of a compartmented bank according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIGS. 1-5 one embodiment of a compartmented bank according to the present invention. Referring to FIG. 1, the bank 10 comprises a hollow body 12, preferably but not necessarily shaped like a pig or other animal. In the illustrated embodiment, the bank 10 is shaped like a pig having a body 12, a head 13 and feet 14 extending generally downward from the body 12.

Figure 5:
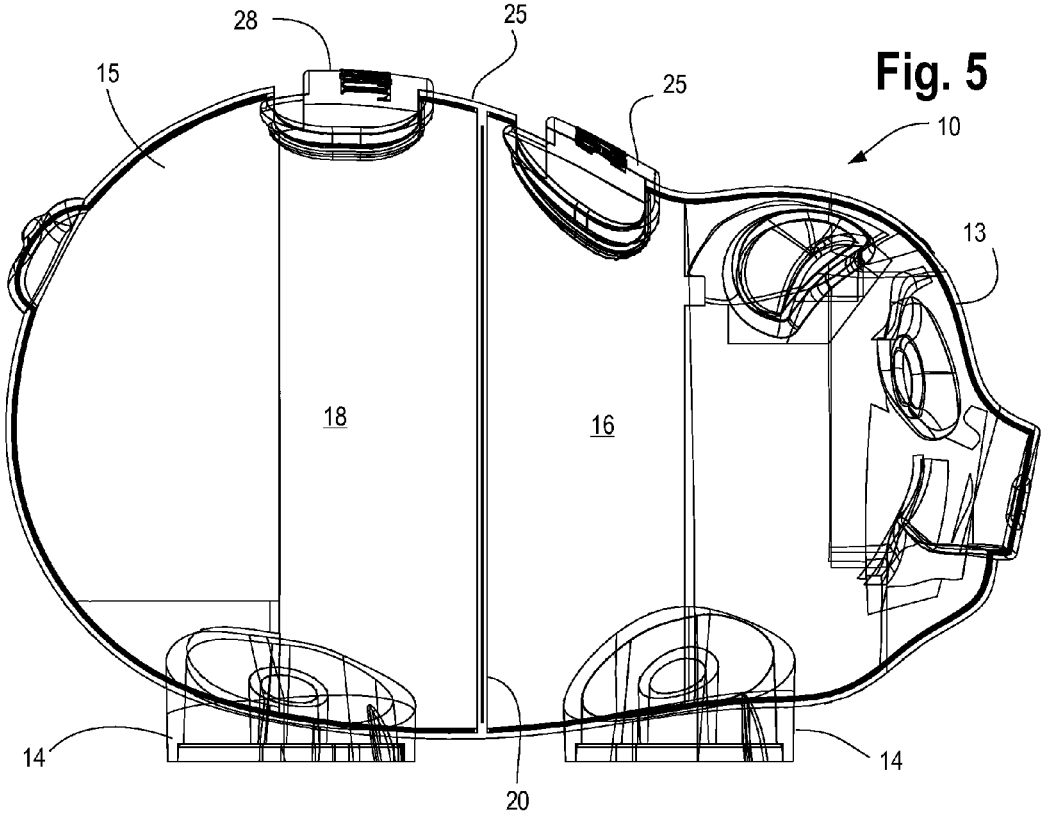
FIG. 5 is a right side cross-sectional view of the bank of FIG. 1 taken along line 5-5 of FIG. 2.

The body 12 may be divided into a plurality (two or more) compartments. For example, as best shown in FIG. 5, the body 12 is divided into two compartments 16, 18, by an internal wall 20. The internal wall 20 preferably extends from the top of the hollow body 12 to the bottom, and from one side of the body 12 to the other to completely segregate the two compartments 16, 18.

Figure 3:
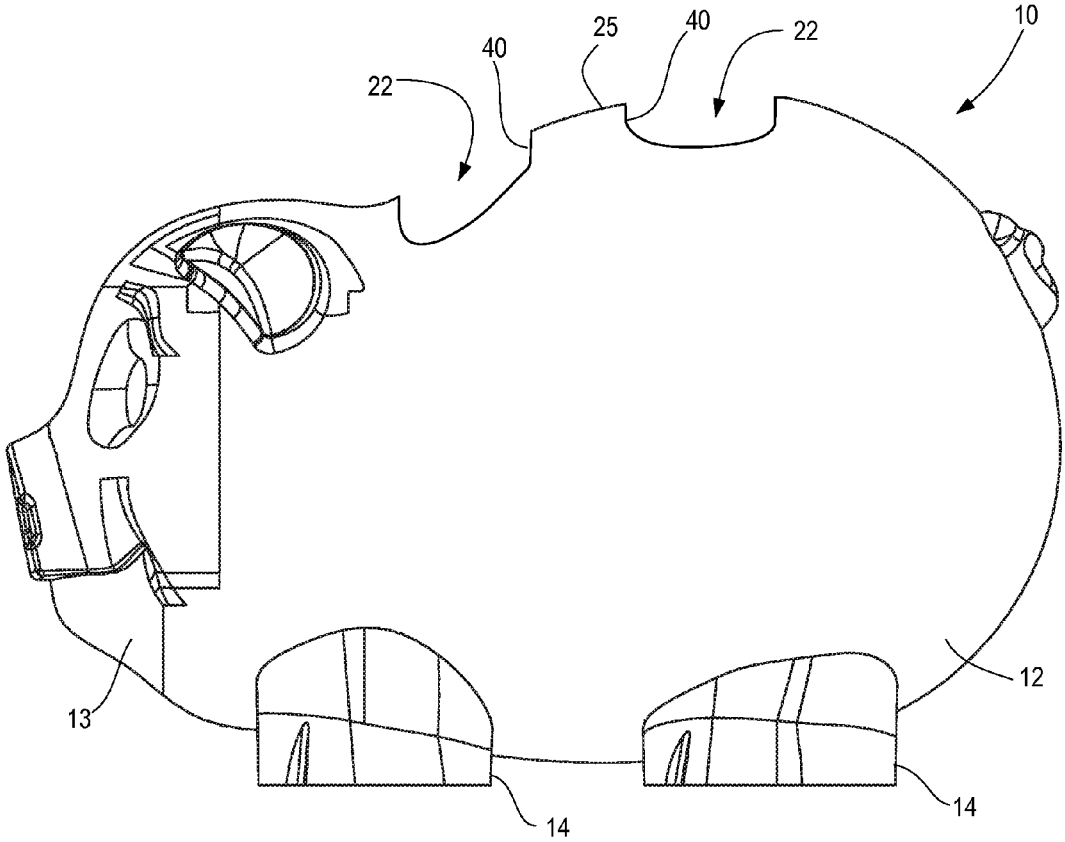
FIG. 3 is a left side view of the bank of FIG. 1.
Figure 4:
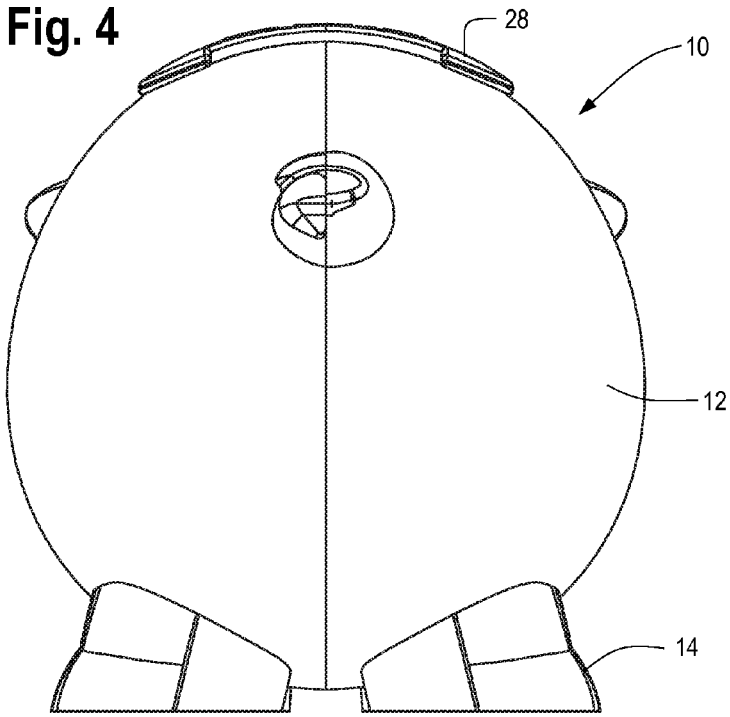
FIG. 4 is a rear view of the bank of FIG. 1.

Referring now to FIG. 3, the body 12 is provided with one or more openings 22, 24 located on its upper surface 25, each opening 22, 24 communicating with one of the compartments 16, 18. Each opening 22, 24 has an opening perimeter 40 and is configured to receive a plug 26, 28.

Figure 2:
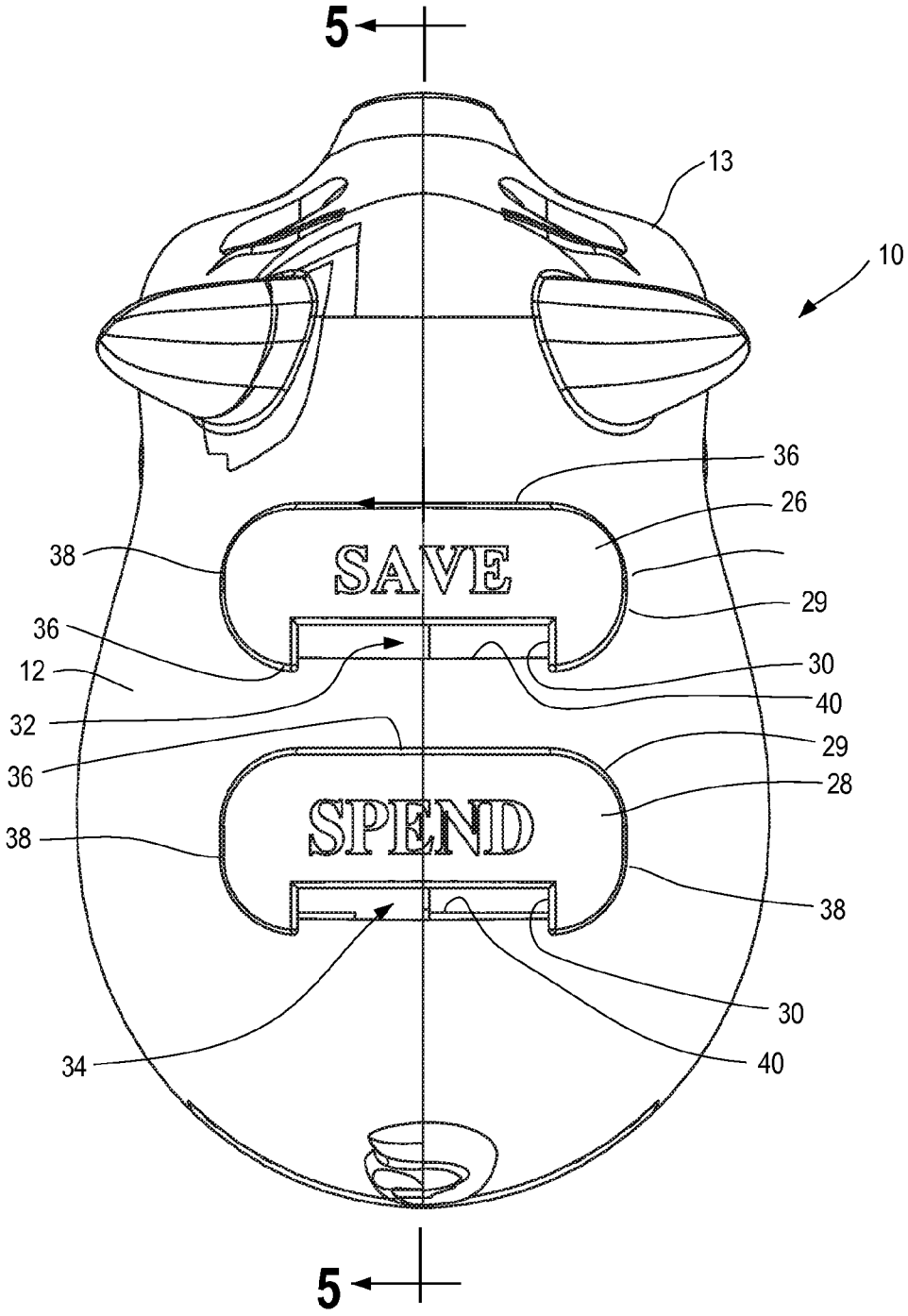
FIG. 2 is a top view of the bank of FIG. 1.

As best shown in FIGS. 1 and 2, each plug 26, 28 has a perimeter 29 having a notch or cutout portion 30 so that, when the plug 26, 28 is fitted over the opening 22, 24, the notch 30 and part of the opening perimeter 40 define an elongated slot 32, 34 through which coins or paper money (not shown) can be inserted into the bank compartments 16, 18.

In the illustrated embodiment the perimeter 29 of each plug 26, 28 is shaped like a rectangle with rounded (curved) ends. That is, each plug 26, 28 has two substantially straight, parallel sides 36 connected by curved ends 38. One of the substantially straight sides 36 includes the notch 30 that, along with a portion of the opening perimeter 40, defines the slot 32, 34.

Alternatively, each plug 16, 18 may include a slot (not shown) disposed away from its perimeter 29 such that, when the plug 16, 18 is fitted over the opening 22, 24, coins or paper money can still be inserted through the slots into the bank compartments 16, 18.

Each plug 26, 28 bears or is otherwise marked with indicia 42 to indicate the budgetary purpose of the corresponding compartment 16, 18. For example, in the illustrated embodiment the indicia 42 consists of the words "SAVE" and "SPEND", although it should be understood that other appropriate words or symbols can be used. The user deposits money, either coins or bills, into the slot 32, 34 corresponding to the particular purpose for which that money is to be used. The body 12 preferably is translucent so that the deposited money can be readily seen through the body 12.

In an alternative embodiment not shown in the figures, the bank 12 itself may bear indicia or other markings near each opening to indicate the budgetary purpose of the corresponding compartment 16, 18, as taught in co-owned U.S. Pat. No. 6,976,619, incorporated herein by reference.

Money stored within the bank 12 may be dispensed (removed) through the openings 22, 24 by removing the appropriate plug(s) 26, 28. Alternatively, money may be dispensed through removable plugs (not shown) located elsewhere on the body 12, such as on the bottom of the feet 14.

Preferably the bank is made of high density polyethylene (HDPE) or other plastic material and the plugs are made from rubber or a resilient rubber-like material.

Thus there has been provided a bank for holding money to be used for various budgetary purposes. Unlike previous banks, the present bank has slots defined by notched plugs inserted into openings located on the upper surface of the bank. Money is stored in the bank by inserting it through the slots. The money may be dispensed (withdrawn) from the bank by removing the plugs and turning the bank upside down. The plugs bear indicia indicating the purpose to which the money is being stored in the bank. The bank is particularly useful in teaching young persons how to manage money.

Although the invention has been described in terms of a piggy bank, it should be understood that the bank body can be almost any shape, including but not limited to other animals, such as a cow, horse, lamb, dog or fish.

Other modifications and alternative embodiments of the invention are contemplated which do not depart from the scope of the invention as defined by the foregoing teachings and appended claims. It is intended that the claims cover all such modifications that fall within their scope.

I claim:

1. A bank for holding money, the bank comprising:

a hollow body having an upper surface; and one or more openings and located on the body upper surface, each of the one or more openings having an opening perimeter and configured to receive a removable plug;

each plug having a perimeter having a notch;

the notch and part of the opening perimeter defining an elongated slot through which coins or paper money can be inserted into the bank;

wherein each plug has two, substantially straight, parallel sides connected by ends, and wherein the notch is formed in one of the substantially straight sides.

2. The bank of claim 1 wherein the ends of the plug are curved.

3. The bank of claim 1 wherein the hollow body is divided into a plurality of segregated compartments by internal walls, and each of the one or more openings communicates with one of the compartments.

4. The bank of claim 3 wherein each plug bears indicia to indicate the budgetary purpose of the corresponding compartment.

5. The bank of claim 3 wherein the body bears indicia located near each opening to indicate the budgetary purpose of the corresponding compartment.

6. The bank of claim 1 wherein the bank is shaped like an animal.

7. The bank of claim 6 wherein the bank is shaped like a pig.

8. The bank of claim 7 wherein the bank has a head and feet.

9. The bank of claim 1 wherein the hollow body is made from translucent plastic material.

* * * * *